US006129568A

United States Patent [19]

Mercurio et al.

[11] Patent Number: 6,129,568

[45] Date of Patent: Oct. 10, 2000

[54] INTERCHANGEABLE ELECTRICAL CONNECTOR

[75] Inventors: Gregory A. Mercurio, Vacaville; Richard N. Marsh, Cool; Demian T. Martin, Pacifica, all of Calif.

[73] Assignee: Monster Cable Products, Inc., Brisbane, Calif.

[21] Appl. No.: 08/890,695

[22] Filed: Jul. 11, 1997

[51] Int. Cl.[7] ..... H01R 29/00

[52] U.S. Cl. ..... 439/166

[58] Field of Search ..... 439/166, 174, 439/175, 176, 891, 879

[56] References Cited

U.S. PATENT DOCUMENTS

| | | | |
|---|---|---|---|
| 4,405,196 | 9/1983 | Fulton | 439/551 |
| 4,944,686 | 7/1990 | Gertz | 439/175 |
| 5,662,489 | 9/1997 | Stirling | 439/322 |
| 5,791,919 | 8/1998 | Brisson et al. | 439/166 |

*Primary Examiner*—Steven L. Stephan
*Assistant Examiner*—Barry M. L. Standig
*Attorney, Agent, or Firm*—LaRiviere, Grubman & Payne, LLP

[57] ABSTRACT

An interchangeable electrical connector includes a connector body and an adapter body. The connector body includes electrical contact means, such as a banana plug tip, for engaging an electrical terminal. The connector body includes a conical portion and a threaded portion which is coaxial with the conical portion. The adapter body includes a conical portion which is shaped for co-operative engagement with the conical portion of the connector body, and a threaded portion which is coaxial to the conical portion of the adapter body. The threaded portion of the adapter body is for cooperative engagement with the threaded portion of the connector body, such that cooperative rotation of the connector body relative to the adapter body draws the conical portion of the connector body into engagement with the conical portion of the adapter body. The wedging action of the two conical portions frictionally engages the connector body to the adapter body.

15 Claims, 2 Drawing Sheets

INTERCHANGEABLE ELECTRICAL CONNECTOR

TECHNICAL FIELD

The present invention relates to an electrical connector which permits the user of an electrical cable to interchange a number of conventional cable connector ends in a modular fashion, depending on the particular requirements of the terminal to which the cable is to be connected.

BACKGROUND OF THE INVENTION

Manufacturers and retailers of electrical cables are presented with the problem that electrical equipment is manufactured with a variety of different terminals to which the electrical cables are to be connected. To ensure that an end user's needs will be met, the cable manufacturer either has to make a wide range of products differing only in the connectors used, or the retailer or end user has to fit the particular connector required by the electrical equipment. This places additional burdens on the manufacturer and the retailer, and is often inconvenient for the end user.

This is particularly true in the professional and home audiovisual arts, where cabling and interconnects are sophisticated and expensive.

Existing modular connectors have been found to provide unsatisfactory signal transmission and unreliable physical connection.

Accordingly, there is a need for an electrical connector which permits the rapid interchange of conventional connector ends, while providing a secure and reliable electrical connection.

SUMMARY OF THE INVENTION

According to the invention, there is provided an interchangeable electrical connector comprising a connector body and an adapter body.

The connector body includes a conical portion, and a threaded portion which is coaxial with the conical portion. The connector body also includes electrical contact means located at an end thereof, for engaging an electrical terminal.

The adapter body includes a conical portion which is shaped for co-operative engagement with the conical portion of the connector body, and a threaded portion which is coaxial to the conical portion of the adapter body. The threaded portion of the adapter body is for cooperative engagement with the threaded portion of the connector body in use, whereby cooperative rotation of the connector body relative to the adapter body draws the conical portion of the connector body into engagement with the conical portion of the adapter body.

A wedging action results when the two conical portions are drawn into contact by the screw threads. This wedging action frictionally engages the connector body to the adapter body, and ensures a reliable electrical and physical connection.

The connector body may be provided with any one of a number of electrical contact means such as a banana plug tip, or a spade type electrical contact.

Other features of the invention are disclosed or apparent in the section entitled "BEST MODE OF CARRYING OUT THE INVENTION"

BRIEF DESCRIPTION OF THE DRAWINGS

For fuller understanding of the present invention, reference is made to the accompanying drawings in the following detailed description of the Best Mode of Carrying Out the Invention. In the drawings.

BEST MODE OF CARRYING OUT THE INVENTION

As electrical connectors are well-known in the art, in order to avoid confusion, while enabling those skilled in the art to practice the claimed invention, this specification omits many details with respect to known items.

For the purposes of this patent specification and claims, the term "conical" shall be interpreted to include "frusto-conical", and shall further be interpreted to include a conical segment.

Figure 1:
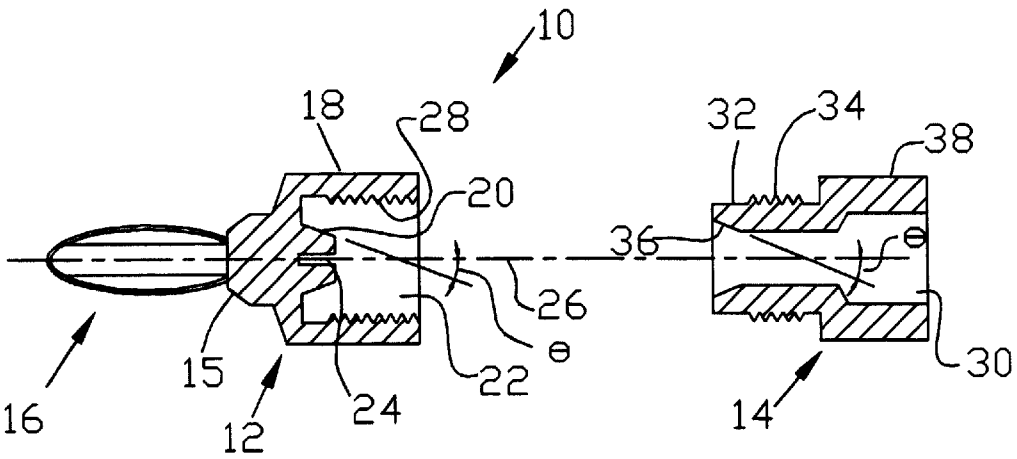
FIG. 1 is a longitudinal cross-sectional view of a first embodiment of an interchangeable electrical connector according to the invention.

FIG. 1 illustrates the a first embodiment of an electrical connector according to the invention. The electrical connector, generally indicated by the numeral 10, comprises a connector body 12 and an adapter body 14. Located at the front end 15 of the connector body 12 is an electrical contact means in the form of a banana plug tip 16.

The banana plug tip 16 comprises a series of longitudinally extending spring members, which in use engage the interior of a corresponding female socket or terminal, in a manner well known in the art.

The rear end of the connector body 12 comprises a cylindrical tubular wall 18 and a male conical portion 20. The conical portion 20 is located in a recess 22 defined by the wall 18, and has a hole 24 defined therein. The hole 24 provides a region wherein a center insulator of a cable can be received.

Formed on the interior surface of the wall 18 are screw threads 28, whereby the adapter body 14 is drawn into engagement with the connector body 12, as described below.

As can be seen from FIG. 1, the longitudinal axis of a cylinder defined by the screw thread 18, and the longitudinal axis of the conical portion 20 coincide, i.e., the conical portion 20 and the screw threads 20 are coaxial about the longitudinal axis 26 of the connector body 12.

The adapter body 14 is generally cylindrical in shape, and has a bore 30 defined therein. The front end 32 of the adapter body 14 has screw threads 34 defined therein. The screw threads 34 have a pitch and effective diameter which are chosen to provide cooperative engagement with the screw threads 28 defined in the rear end of the connector body 12.

Defined in the front end 32 of the adapter body 14 is a female conical portion 36 which forms part of the bore 30. The conical portion 36 is shaped for co-operative mating engagement with the conical portion 24 of the connector body 12. In other words, the angle θ illustrated in the Figure is substantially the same for both conical portions 24, 36, and the respective sizes of the conical portions 20, 36 are complementary.

The angle θ may vary between different electrical connectors according to the invention, but in the illustrated embodiment, θ is approximately 27.5°, and is preferably between 0° and 90°, and more preferably between 0° and 45°. Also, the angle θ for the the conical portion 24 may differ by a small amount from the angle θ for the conical portion 36. In the preferred embodiment of an electrical connector incorporating such a difference, the difference is approximately 3°. This difference between the two angles is believed to provide an improved interference between the two conical portions 24 and 36, which further assists in preventing loosening of the connector body 12 and the adapter body 14 from one another in use.

As with the connector body 12, the longitudinal axis of a cylinder defined by the adapter body screw threads 34, and the longitudinal axis of the conical portion 36 coincide, i.e., the conical portion 36 and the screw threads 34 are coaxial about the longitudinal axis 26 of the adapter body 14.

The outer surface of the rear end 38 of the adapter body 14 has approximately the same diameter as the outer surface of the wall 18 of the connector body 12, so that when the connector 10 is assembled in use, the outer surface of the connector 10 is smooth and uniform.

The bore 30 at the rear end 38 of the adapter body 14 is shaped and sized to receive an end of an electrical conductor such as a speaker cable or audio-visual interconnect cable. Such a cable may be soldered, welded or crimped into place in the bore 30.

The bore 30 has a narrower portion defined in the middle thereof which will prevent an appropriately sized cable from being inserted too far into the adapter body 14. This assists in determining the correct depth of insertion for the cable during assembly of the adapter body 14 to the cable end.

In use, the rear end 38 of the adapter body 14 is secured to the end of an electrical conductor such as a loudspeaker cable. The user selects an appropriate connector body 12 based on which electrical contact means, in this case the banana plug tip 16, is required for the task at hand.

The front end 32 of the adapter body 14 is inserted into the recess 22 defined in the rear end of the connector body 12, thereby to bring the screw threads 34 and 20 into engagement with each other. The connector body 12 is then rotated relative to the adapter body 14 about the longitudinal axis 26, until the conical portion 20 of the connector body 12 is brought into engagement with the conical portion 36 of the adapter body 14. The relative rotation is continued until a "hand tight" or "finger tight" connection is obtained. The banana plug tip 16 can then be inserted into an electrical socket.

The advantage of using a configuration as described above is that the longitudinal forces resulting from the screwing together of the connector body 12 and the adapter body 14 cause strong transverse clamping forces at 20 and 36, as a result of the conical wedging action of the cooperating conical surfaces 20 and 36. This provides good electrical contact between the connector body 12 and the adapter body 14 for signal transmission. Also, as a result of the relatively large transverse clamping forces, correspondingly large frictional forces arise at the interface of the conical surfaces, which provides a reliable physical connection.

Of course, should the user require another electrical contact means at the end of the cable, the connector body 12 may be removed by unscrewing it from the adapter body 14, and it can easily be replaced by another connector body having the appropriate electrical contact means.

The electrical connector of the invention has the advantage that a cable supplier need manufacture and supply only one cable with an adapter body 14 secured at one or both ends thereof, together with a number of connector bodies 12 having different electrical contact means at the front thereof. This simplifies production and distribution for the manufacturer, while providing the customer with a more versatile product.

Figure 2:
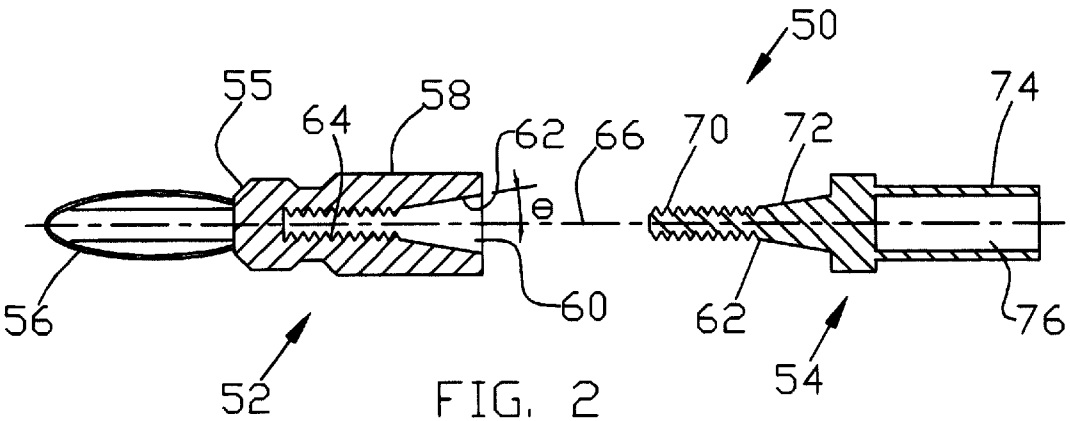
FIG. 2 is a longitudinal cross-sectional view of a second embodiment of an interchangeable electrical connector according to the invention.

The best mode embodiment of an electrical connector according to the invention is illustrated in FIG. 2. The electrical connector, generally indicated by the numeral 50, again comprises a connector body 52 and an adapter body 54. Located at the front end 55 of the connector body 52 is an electrical contact means, again in the form of a banana plug tip 56.

The rear end 58 of the connector body 52 has a bore 60 defined therein for receiving the front end of the adapter body 54. The outer portion of the surface defining the bore is formed as a female conical portion 62, while the inner portion of the surface defining the bore is formed with screw threads 64.

As can be seen from the Figure, the longitudinal axis of a cylinder defined by the screw threads 64, and the longitudinal axis of the conical portion 62 coincide, i.e., the conical portion 62 and the screw threads 64 are coaxial about the longitudinal axis 66 of the connector body 52.

The front end of the adapter body 54 comprises a dowel 68. The forward portion of the dowel 68 is formed with screw threads 70, which have the same pitch and effective diameter for cooperative engagement with the screw threads 64 defined in the rear end of the connector body 52.

Adjacent to the screw threads 70, the dowel 68 is tapered to define a male conical portion 72. The conical portion 72 is shaped for co-operative mating engagement with the conical portion 62 of the connector body 52, as in the FIG. 1 embodiment. Again, the conical portions 62, 72 respectively define an angle θ which may vary between different electrical connectors according to the invention, but in the illustrated embodiment, θ is approximately 3° for the connector body 52 and 4.5° for the adapter body 54. The angles θ for the connector body 52 and the adapter body 54 can be between 0° and 90°, but are preferably between 0° and 45°.

As described above with reference to the FIG. 1 embodiment, Applicants' believe that, by providing a difference between the angles θ for the connector body 52 and the adapter body 54, an improved interference between the two conical portions 24 and 36 results, which assist in the prevention of the loosening of the connector body 52 and the adapter body 54 from one another in use.

As with the connector body 52, the longitudinal axis of a cylinder defined by the adapter body screw threads 70, and the longitudinal axis of the conical portion 72 coincide, i.e., the conical portion 72 and the screw threads 70 are coaxial about the longitudinal axis 66 of the adapter body 54.

The rear end 74 of the adapter body 54 is tubular in shape, and defines a blind bore 76 which is shaped and sized to receive an end of an electrical conductor such as a speaker cable or audio-visual interconnect cable, which in use is soldered, welded or crimped into place in the bore 76.

In use, the user again selects an appropriate connector body 52 based on the required electrical contact means, in this case the banana plug tip 56.

The front end of the adapter body 54 is inserted into the bore 60 defined in the connector body 52 until the screw threads 64 and 70 are brought into engagement with each other. The connector body 52 is then rotated relative to the adapter body 54 about the longitudinal axis 66, until the conical portion 62 of the connector body 52 is brought into engagement with the conical portion 72 of the adapter body 54. The relative rotation is continued until a "hand tight" or "finger tight" connection is obtained.

The combined action of the screw threads 64, 70 and the conical surfaces 72, 62 again provides the conical wedging forces, and the advantages associated therewith, described above with reference to the FIG. 1 embodiment of the invention.

Figure 3:
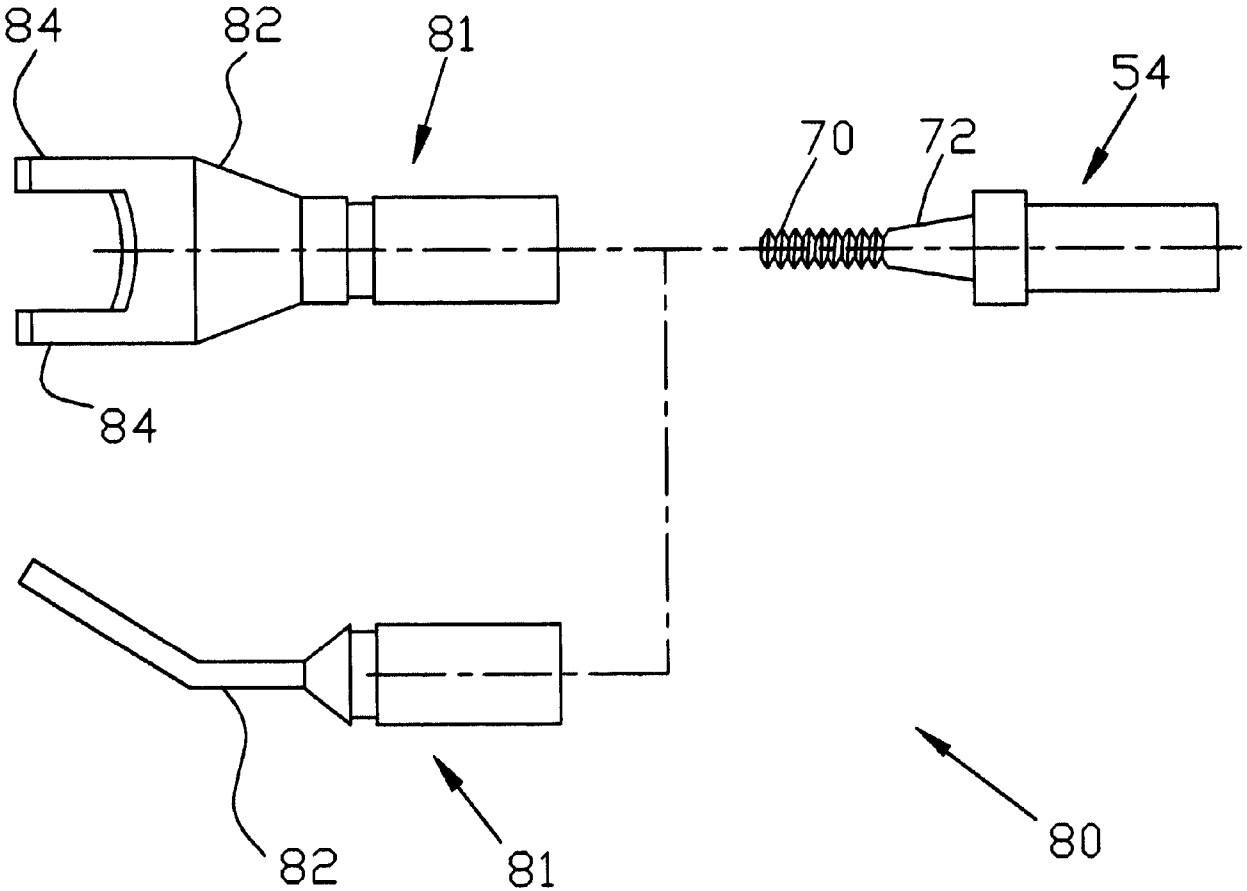
FIG. 3 is a side view of the interchangeable electrical connector of FIG. 2 including a spade electrical contact at the front end of the connector body.

FIG. 3 shows an interchangeable electrical connector 80 which is identical to the electrical connector 50 illustrated in FIG. 2, except that the electrical connection means at the front of the connector body 81 is a spade electrical contact 82. The spade contact 82, which is shown in two views in FIG. 3, is conventional in nature, and comprises and angled plate with two prongs 84. in use, the prongs 84 are placed around a threaded post extending from an electrical terminal, and a fastener is screwed down the post, thereby to clamp the spade contact 84 to the electrical terminal.

It will be appreciated that the connector body 81 with the spade contact 82 is readily interchangeable with the connector body 52 with the banana plug tip 56, depending on the required application. In this regard, a number of different electrical contact means may be provided in addition to the banana plug tip 56 and spade contact 82.

The electrical connectors 10, 50 and 80 are made from conventional materials used in the connector field, and are made using conventional manufacturing techniques.

In an alternative application of the adapter body 54, the front end 68 of the adapter body 50 can be inserted directly into a female electrical terminal. In this regard, a shallow groove of rectangular cross section is defined in the dowel 68 between the screw threads 70 and the conical portion 72. This groove is provided so that the adapter body 50 can be inserted into locking engagement with a particular type of socket, which has one or more blades which are adapted to fit into the groove, thereby to retain the adapter body 50 in the socket.

It will be appreciated that the invention is not limited to the embodiment of the invention described above, and many modifications are possible without departing from the spirit and the scope of the invention.

What is claimed is:

1. An interchangeable electrical connector, comprising:

a connector body comprising a conical portion having a longitudinal axis, the connector body further comprising, a threaded portion being coaxial with the conical portion of the connector body;

an electrical contact means located at a front end of the connector body for engaging an electrical terminal; and an adapter body comprising a conical portion having a longitudinal axis and being shaped for cooperative engagement with the conical portion of the connector body, the adapter body further comprising a threaded portion being coaxial to the conical portion of the adapter body for cooperative engagement with the threaded portion of the connector body, wherein cooperative rotation of the connector body relative to the adapter body draws the conical portion of the connector body into engagement with the conical portion of the adapter body, thereby to secure the connector body to the adapter body wherein said connector body conical portion is defined by a taper in an angular range of 7 degrees to 45 degrees, wherein said adapter body conical portion is defined by a taper in an angular range of 7 degrees to 45 degrees, and wherein said connector body conical portion taper is less than said adapter body conical portion taper by a taper difference in an angular range of greater than 0 degrees to 3 degrees.

2. An electrical connector according to claim 1, wherein:

the connector body includes a tubular wall which defines a recess in a rear end of the connector body;

the threaded portion of the connector body is formed on an interior surface of the tubular wall; and the conical portion of the connector body is a male conical portion located in the recess defined by the tubular wall.

3. An electrical connector according to claim 2, wherein:

the adapter body has a generally cylindrical front end;

the threaded portion of the adapter body is defined on an outer surface of the front end of the adapter body; and the conical portion of the adapter body is a female conical portion defined in the front end of the adapter body.

4. An electrical connector according to claim 3 wherein the adapter body has a bore defined therein which extends from the female conical portion at the front end of the adapter body through to a rear end of the adapter body.

5. An electrical connector according to claim 4 wherein the bore in the adapter body has a narrower portion defined between the female conical portion and the rear end of the adapter.

6. An electrical connector according to claim 1, wherein:

a rear end of the connector body has a bore defined therein for receiving a front end of the adapter body, the bore being defined by an internal surface of the connector body;

the conical portion of the connector body is a female conical portion defined by an outer portion of the surface defining the bore; and the threaded portion of the connector body is defined in by an inner portion of the surface defining the bore.

7. An electrical connector according to claim 6, wherein:

the adapter body has an elongated front end;

the threaded portion of the adapter body is defined on an outer surface of the front end of the adapter body; and the conical portion of the adapter body is a male conical portion defined by a taper in the front end of the adapter body adjacent to the threaded portion.

8. An interchangeable electrical connector, comprising a connector body having a front, a rear end, and a longitudinal axis, the rear end of the adapter body being adapted for engagement with an electrical conductor, the front end of the adapter body defining a conical portion being shaped for cooperative engagement with the conical portion of the connector body, the front end of the adapter body further having screw threads defined therein for cooperative engagement with the screw threads defined in the rear end of the connector body, wherein rotation of the connector body relative to the adapter body draws the conical portion of the connector body into engagement with the conical portion of the adapter body wherein said connector body conical portion is defined by a taper in an angular range of 7 degrees to 45 degrees, wherein said adapter body conical portion is defined by a taper in an angular range of 7 degrees to 45 degrees, and wherein said connector body conical portion taper is less than said adapter body conical portion taper by a taper difference in an angular range of greater than 0 degrees to 3 degrees.

9. An electrical connector according to claim 8, wherein:

the connector body includes a tubular wall which defines a recess in the rear end of the connector body;

the threaded portion of the connector body is formed on an interior surface of the tubular wall; and the conical portion of the connector body is a male conical portion located in the recess defined by the tubular wall.

10. An electrical connector according to claim 9, wherein:

the threaded portion of the adapter body is defined on an outer surface of the front end of the adapter body; and the conical portion of the adapter body is a female conical portion defined in the front end of the adapter body.

11. An electrical connector according to claim 10 wherein the adapter body has a bore defined therein which extends from the female conical portion at the front end of the adapter body through to the rear end of the adapter body.

12. An electrical connector according to claim 11 wherein the bore in the adapter body has a narrower portion defined between the female conical portion and the rear end of the adapter.

13. An electrical connector according to claim 8, wherein:

the rear end of the connector body has a bore defined therein for receiving a front end of the adapter body, the bore being defined by an internal surface of the connector body;

the conical portion of the connector body is a female conical portion defined by an outer portion of the surface defining the bore; and the threaded portion of the connector body is defined in by an inner portion of the surface defining the bore.

14. An electrical connector according to claim 13, wherein:

the front end of the adapter body comprises an elongated dowel;

the threaded portion of the adapter body is defined on an outer surface of the dowel; and the conical portion of the adapter body is a male conical portion defined by a taper in the dowel adjacent to the threaded portion.

15. The electrical connector according to claim 8, wherein:

the rear end of the connector body has a bore defined for receiving a front end of the adapter body, the bore being defined by an internal surface of the connector body;

the conical portion of the connector body is a female conical portion defined by a surface defining the bore;

the front end of the adapter body comprises a dowel;

the threaded portion of the adapter body is defined on an outer surface of the dowel; and the conical portion of the adapter body is a male conical portion defined by a taper in the dowel adjacent to the threaded portion.

* * * * *

UNITED STATES PATENT AND TRADEMARK OFFICE
CERTIFICATE OF CORRECTION

PATENT NO : 6,129,568

DATED : OCTOBER 10, 2000

INVENTOR(S) : GREGORY A. MERCURIO, RICHARD N. MARSH, DEMIAN T. MARTIN

It is certified that error appears in the above-identified patent and that said Letters Patent are hereby corrected as shown below:

In the Title: Replace the title to read - -INTERCHANGEABLE ELECTRICAL CONNECTOR HAVING CONICAL PORTION- -.

In Column 4, Line 38: Delete the apostrophe after the word "Applicants".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*